US009093049B2

(12) United States Patent
Chen

(10) Patent No.: US 9,093,049 B2
(45) Date of Patent: Jul. 28, 2015

(54) DISPLAY WITH ELECTROCHROMIC FILMS AND HAVING LOW POWER CONSUMPTION

(71) Applicant: Wcube Co., Ltd., George Town (KY)

(72) Inventor: Po-Chou Chen, New Taipei (TW)

(73) Assignee: Wcube Co., Ltd., George Town (KY)

( * ) Notice: Subject to any disclaimer, the term of this patent is extended or adjusted under 35 U.S.C. 154(b) by 133 days.

(21) Appl. No.: 13/931,472

(22) Filed: Jun. 28, 2013

(65) Prior Publication Data

US 2014/0118416 A1 May 1, 2014

(30) Foreign Application Priority Data

Oct. 26, 2012 (TW) ..... 101139789 A

(51) Int. Cl.
*G09G 3/38* (2006.01)

(52) U.S. Cl.
CPC ..... *G09G 3/38* (2013.01); *G09G 2300/0456* (2013.01); *G09G 2380/14* (2013.01)

(58) Field of Classification Search
CPC ..... G06F 3/038
USPC ..... 345/48, 49, 77, 84, 105, 211, 212, 690, 345/102; 359/265, 267
See application file for complete search history.

(56) References Cited

U.S. PATENT DOCUMENTS

| | | | | |
|---|---|---|---|---|
| 7,532,383 | B2 * | 5/2009 | Jang et al. | 359/266 |
| 8,743,048 | B2 * | 6/2014 | Takahashi et al. | 345/105 |
| 2006/0204866 | A1 * | 9/2006 | Hirano et al. | 430/7 |
| 2007/0171148 | A1 * | 7/2007 | Cassidy | 345/49 |
| 2011/0222139 | A1 * | 9/2011 | Naijo et al. | 359/270 |
| 2012/0154891 | A1 * | 6/2012 | Yeh et al. | 359/265 |

* cited by examiner

*Primary Examiner* — Pegeman Karimi
(74) *Attorney, Agent, or Firm* — Novak Druce Connolly Bove + Quigg LLP

(57) ABSTRACT

A backlight module of a display provides a backlight controlled by a switch. A first electrochromic film comprises a plurality of first electrochromic devices which may each be powered on to appear white or transparent, and a first power supply module. A second electrochromic film comprises a plurality of second electrochromic devices which may each be powered to appear black or transparent, and a second power supply module. The first electrochromic film is positioned between the backlight module and the second electrochromic film. A controller applies voltages to the first electrochromic devices and to the second electrochromic devices to control appearances of each individual first electrochromic devices and each individual second electrochromic devices.

14 Claims, 4 Drawing Sheets

DISPLAY WITH ELECTROCHROMIC FILMS AND HAVING LOW POWER CONSUMPTION

BACKGROUND

1. Technical Field

The present disclosure relates to a display, and particularly to a power saving display.

2. Description of Related Art

An electronic display device (such as a mobile phone or e-book) is generally provided with a backlight module, but if the backlight module is turned off, user cannot see the display. Therefore, the backlight module must remain turned on all the time, which consumes a large amount of power.

Therefore, it is necessary to provide an effective power saving display.

SUMMARY OF THE INVENTION

The present disclosure is described in relation to a display. The display includes microprocessor, a backlight module, a switch, a first electrochromic film, a first power supply module, a second electrochromic film, a second power supply module, and a controller. The microprocessor receives an image having a number of white pixels and a number of black pixels. The backlight module provides a backlight. The switch controls turning on and turning off of the backlight module. The first electrochromic film includes a matrix-like arrangement of a number of first electrochromic devices corresponding to a number of pixels of the image. The first power supply module is electrically connected to the first electrochromic film. The second electrochromic film includes a matrix-like arrangement of a plurality of second electrochromic devices corresponding to a number of pixels of the image. The second power supply module is electrically connected to the second electrochromic film. The controller is electrically connected to the microprocessor and the switch. The controller controls voltage of the first power supply module applied to the first electrochromic device and voltage of the second power supply module applied to the second electrochromic device, and controls changing appearance of the first electrochromic device and the second electrochromic device.

When the backlight module turns on, emitted light of the backlight module passes through both the first and second electrochromic device corresponding to white pixels of the image, making a background of the display appears white, simultaneously. The emitted light of the backlight module cannot pass through the first electrochromic device or the second electrochromic device corresponding to black pixels of the image, making the display appear black.

When the backlight module turns off, external light is reflected by the first electrochromic device or the second electrochromic device corresponding to the white pixels of the image, making the display appear white, simultaneously the external light is absorbed by the first electrochromic device or the second electrochromic device corresponding to the black pixels of the image, making the display appear black.

The display of the present disclosure allows the user to make use of ambient or external lighting to see and read the display when the external lighting is strong enough. When the external lighting is not sufficient, the user may always turn on the backlight module to observe the image.

BRIEF DESCRIPTION OF THE DRAWINGS

Many aspects of the display can be better understood with reference to the following drawings. The components in the drawings are not necessarily drawn to scale, the emphasis instead being placed upon clearly illustrating the principles of the present display. In the drawings, all the views are schematic.

DETAILED DESCRIPTION

Figure 1:
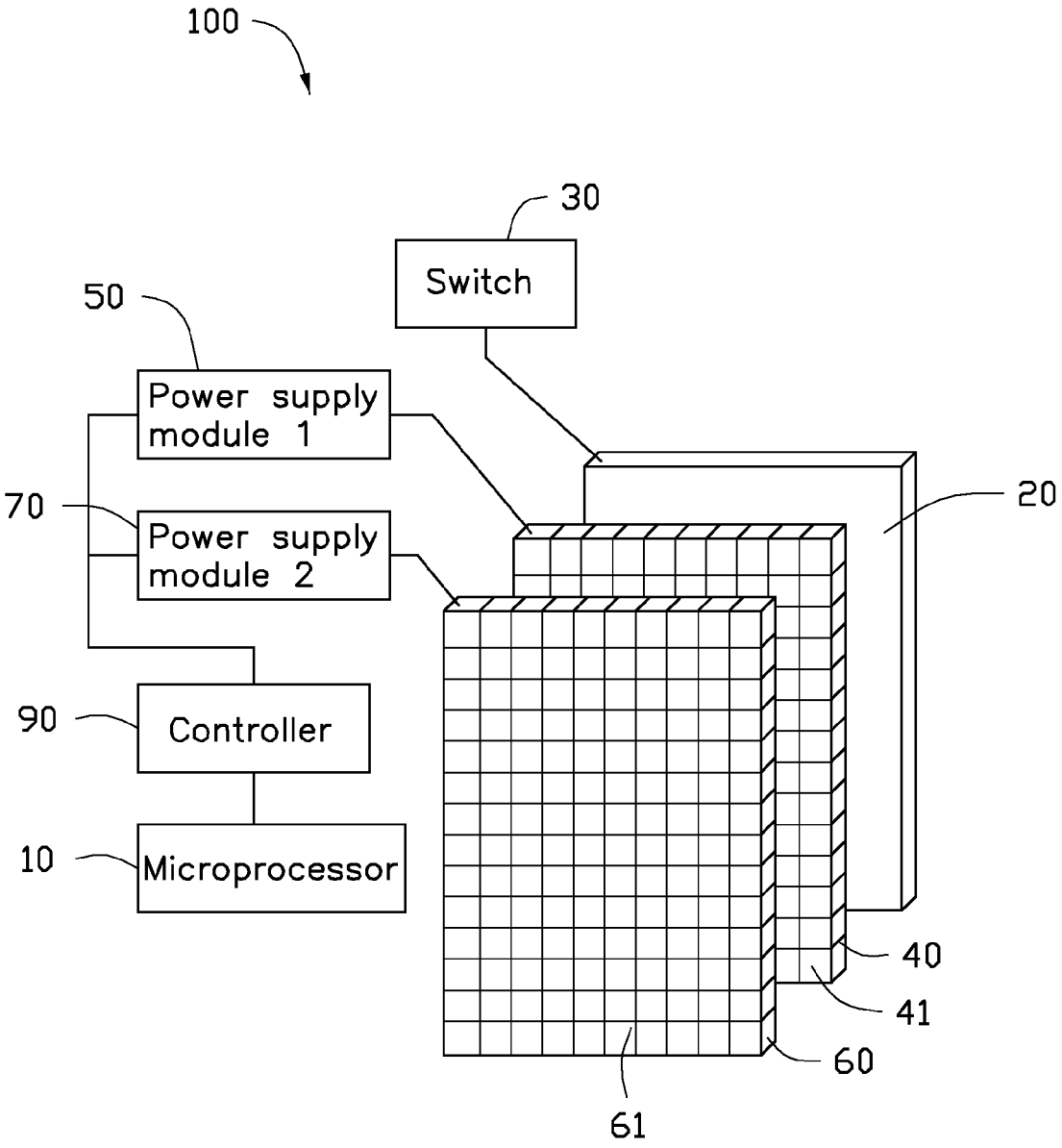
FIG. 1 is a schematic view of the display structure including first and second power supply modules.
Figure 2:
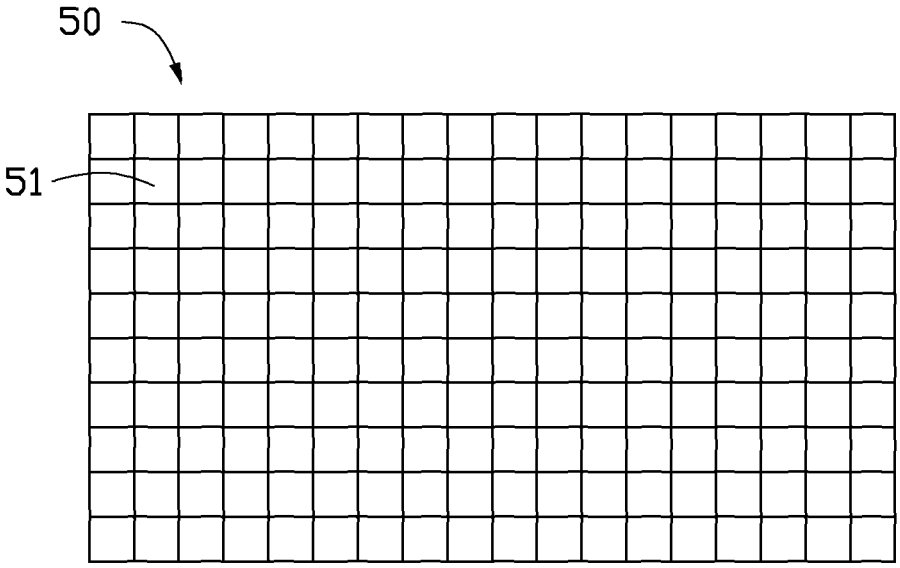
FIG. 2 is a schematic view of the first power supply module of the display of FIG. 1.
Figure 3:
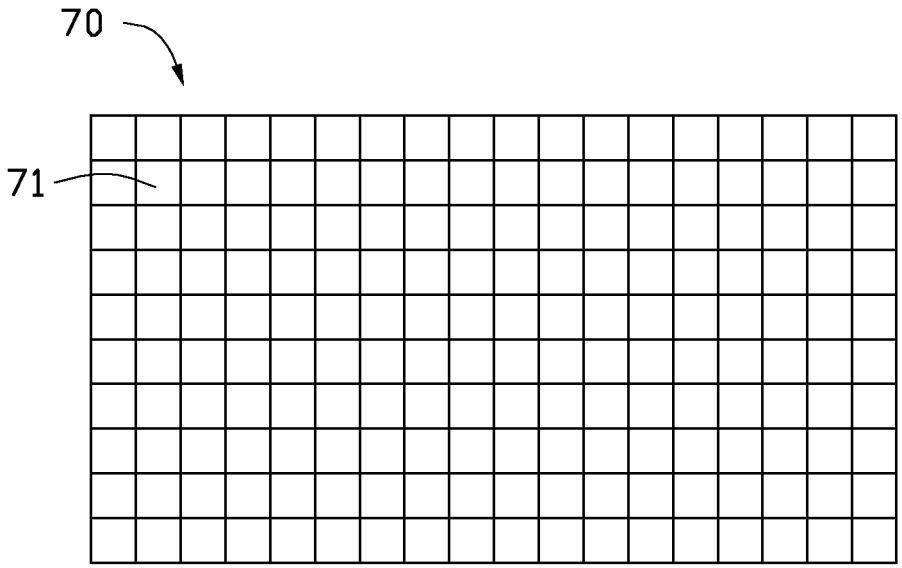
FIG. 3 is a schematic view of the second power supply module of the display of FIG. 1.

Referring to FIG. 1, the present disclosure provides a display 100 which includes a microprocessor 10, a backlight module 20, a switch 30, a first electrochromic film 40, a first power supply module 50, a second electrochromic film 60, a second power supply module 70, and a controller 90. The first electrochromic film 40 is positioned between the backlight module 20 and the second electrochromic film 60. The microprocessor 10 receives an image, the image including luminance information governing brightness of each pixel in the display. The microprocessor 10 can recognize a luminance value of each pixel in the display from the image data. Classified according to the luminance values, the information for plurality of pixels of an image includes a plurality of white pixels and a plurality of black pixels. For example, a luminance value of 255 would be completely white; a luminance value of 0 would be a completely black. The backlight module 20 provides a backlight. The switch 30 controls turning on and turning off of the backlight module 20. Specifically, when the switch 30 is in a first state, the backlight module 20 is on and when the switch 30 is in a second state, the backlight module is off The first electrochromic film 40 is set on the backlight module 20. The first electrochromic film 40 includes a matrix-like arrangement of a plurality of first electrochromic devices 41. Each of the plurality of first electrochromic devices 41 corresponds to a plurality of pixels of the image. In the present embodiment, the first electrochromic device 41 is capable of changing its ability to refract or reflect light under the influence of an applied voltage. The first power supply module 50 electrically connected to the first electrochromic film 40. As shown in FIG. 2, the first power supply module 50 includes a plurality of first power connections 51 corresponding to the plurality of first electrochromic devices 41. Each of the first power connections 51 electrically connected to the first electrochromic device 41 provides two different values of voltage, so that a first electrochromic device 41 exhibits transparency or blackness after being switched on. The second electrochromic film 60 is set on the first electrochromic film 40 farthest from the backlight module 20. The second electrochromic film 60 includes a matrix-like arrangement of a plurality of second electrochromic devices 61. Each of the second electrochromic devices 61 corresponds to the first electrochromic devices 41 and corresponds to a plurality of pixels of the image. In the present embodiment, the second electrochromic device 61 has properties similar to those of the first electrochromic device 41. The second power supply module 70 electrically connected to the second electrochromic film 60, as shown in FIG. 3. Each of a second power connections 71 supplies power to the second electrochromic device 61, in providing two different voltage values, so that the second electrochromic device 61 exhibits transparency or whiteness after switched on. The optical properties (reflectance, transmittance, absorptance) of the first electrochromic device 41 and of the second electrochromic device 61, under the action of an electric field allow stable and reversible appearances.

Figure 4:
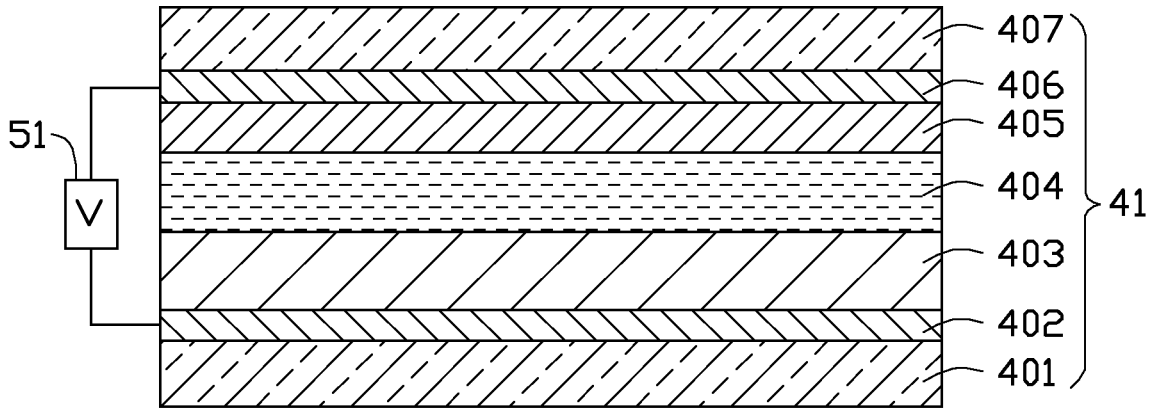
FIG. 4 is a schematic view of the fist electrochromic device of the display of FIG. 1.

Specifically, as shown in FIG. 4, the first electrochromic device 41 includes a sequential stacking, in the following orders, a first transparent base layer 401, a first transparent conductive layer 402, an electrochromic layer 403, an electrolyte layer 404, an ion storage layer 405, a second transparent conductive layer 406 and a second transparent base layer 407. In the present embodiment, the first transparent base layer 401 and the second transparent base layer 407 are made of glass; the first transparent conductive layer 402 and the second conductive layer 406 are made of indium tin oxide (ITO); the electrochromic layer 403 is made of electrochromic materials; the electrolyte layer 404 is made of conductive materials, such as lithium perchlorate or sodium perchlorate solutions or solid electrolytic materials; the ion storage layer 405 is made of electrochromic materials, wherein an electrochromic properties of the electrochromic materials is in contrast to the electrochromic layer; if anodic oxidation electrochromic materials are used in the electrochromic layer 403, then the ion storage layer 405 uses cathodic reduction electrochromic materials.

An operating principle of the first electrochromic device 41 is as follows: when a certain potential difference exists between the first transparent conductive layer 402 and second transparent conductive layer 406, since the electrochromic layer 403 is made of electrochromic materials, an oxidation-reduction reaction occurs under an influence of the voltage, and an appearance of the electrochromic layer changes. The ion storage layer 405 stores balancing counter-ions when the oxidation-reduction reaction occurs in the electrochromic layer 403, to maintain the whole system charge balance. The ion storage layer 405 and the electrochromic layer 403 play either an appearance overlay or a complementary role. That is, the first electrochromic device 41 subjected to the electric field allows an electrochemical oxidation-reduction reaction, and gains or loses electrons, changing an appearance of the first electrochromic device 41.

The second electrochromic device 61 and the first electrochromic device 41 have basically the same structure, but the material of the electrochromic layer of the second electrochromic device 61 is different to the first electrochromic device 41. The controller 90 and the microprocessor 10 and switch 30 carry out electrical functions, thus the backlight module 20 may be on or off depending on a luminance values. The voltage of the first power supply module 50 applied to the first electrochromic device 41 and the voltage of the second power supply module 70 applied to the second electrochromic device 61 is changed in accordance with the luminance values of the pixels, to make the display 100 display a legible image. Specifically, when the switch 30 in the first state, the backlight module 20 turns on. At this moment, the controller 90 controls the second electrochromic devices 61 corresponding to the white pixels of the image, to switch on and become transparent, and the first electrochromic devices 41 corresponding to the white pixels of the image to switch on and become transparent; simultaneously, the controller 90 controls the second electrochromic devices 61 corresponding to the black pixels of the image to switch on and become transparent, the first electrochromic devices 41 corresponding to the black pixels of the image to switch on and become black. When the switch 30 in the second state, the backlight module 20 turns off. At this moment, the controller 90 controls the second electrochromic devices 61 corresponding to the white pixels of the image to switch on and turn white, and the first electrochromic devices 41 corresponding to the white pixels of the image to switch on and turn transparent; simultaneously, the controller 90 controls the second electrochromic devices 61 corresponding to the black pixels of the image to switch on and turn transparent, and the first electrochromic devices 41 corresponding to the black pixels of the image to switch on and become black.

The working process of the display 100 is as follows: when an external lighting is not sufficient, user turns on the backlight module 20 to see a page better. The second electrochromic devices 61 corresponding to the white pixels of the image to switch on and turn transparent, simultaneously the first electrochromic devices 41 corresponding to the white pixels of the image are also turned transparent, enabling an emitted light of the backlight module 20 to pass through both first and second devices 41 and 61, making background of the display 100 appears white, as a result of emitted color of the backlight. The second electrochromic devices 61 corresponding to the black pixels of the image are switched on and turn transparent, simultaneously the first electrochromic devices 41 corresponding to the black pixels of the image are switched on and turn black, enabling the emitted light of the backlight module 20 to pass through the second electrochromic devices 61 corresponding to the black pixels of the image, then absorbed by the first electrochromic devices 41, thus no light from those points enters into the eye of user, the display 100 displaying black constituting the image. The white and the black together compose the image.

When the external lighting is sufficient, the user may turn off the backlight module 20. The second electrochromic devices 61 corresponding to the white pixels of the image to switch on and turn white, simultaneously the first electrochromic devices 41 corresponding to the white pixels of the image to switch on and turn transparent. The external lighting is reflected by the second electrochromic devices 61 corresponding to the white pixels of the image, making the background of the display 100 appears white. The second electrochromic devices 61 corresponding to the black pixels of the image to switch on and turn transparent, simultaneously the first electrochromic devices 41 corresponding to the black pixels of the image to switch on and turn black, the external lighting to pass through the second electrochromic devices 61 corresponding to the black pixels of the image is absorbed by the first electrochromic devices 41, and thus no light enters into the eye of user, the display 100 displaying black. The white and the black compose the image.

Compared to a prior art, the display 100 of the present disclosure allows the user to make use of ambient or external lighting to see and read the display when the external lighting is strong enough. When the external lighting is not sufficient, the user may always turn on the backlight module 20 to observe the image.

In the present embodiment, boost and buck circuits are provided inside the first power connections 51 and the second power connections 71, so that voltages of the first power connections 51 and of the second power connections 71 can be directly adjusted in accordance with an instructions of the controller 90. In another embodiment, the first power connections 51 and the second power connections 71 include two sub-power supplies, enabling output different voltage values.

Although the present disclosure has been specifically described on the basis of this exemplary embodiment, the disclosure is not to be construed as being limited thereto. Various changes or modifications may be made to the embodiment without departing from the scope and spirit of the disclosure.

What is claimed is:

1. A display, comprising:

a microprocessor receiving an image, the image comprising:

a plurality of white pixels; and a plurality of black pixels;

a backlight module providing a backlight;

a switch controlling turning on and turning off of the backlight module;

a first electrochromic film comprising a matrix-like arrangement of a plurality of first electrochromic devices corresponding to a plurality of pixels of an image;

a first power supply module electrically connected to the first electrochromic film;

a second electrochromic film comprising a matrix-like arrangement of a plurality of second electrochromic devices corresponding to a plurality of pixels of the image;

a second power supply module electrically connected to the second electrochromic film; and a controller electrically connected to the microprocessor and the switch;

wherein the controller controls voltage of the first power supply module applied to the first electrochromic device and voltage of the second power supply module applied to the second electrochromic device, and controls changing appearance of the first electrochromic device and the second electrochromic device;

wherein when the backlight module turns on, emitted light of the backlight module passes through both the first and second electrochromic device corresponding to white pixels of the image, making a background of the display appears white, simultaneously, the emitted light of the backlight module cannot pass through the first electrochromic device or the second electrochromic device corresponding to black pixels of the image, making the display appear black;

and wherein when the backlight module turns off, external light is reflected by the first electrochromic device or the second electrochromic device corresponding to the white pixels of the image, making the display appear white, simultaneously the external light is absorbed by the first electrochromic device or the second electrochromic device corresponding to the black pixels of the image, making the display appear black.

2. The display as claimed in claim 1, wherein the first power supply module comprises a plurality of first power connections corresponding to a plurality of first electrochromic devices, each of the first power connections electrically connected to the corresponding first electrochromic device; the second power supply module comprising a plurality of second power connections corresponding to a plurality of second electrochromic device, each of the second power connections electrically connected to the corresponding second electrochromic device.

3. The display as claimed in claim 2, wherein the first electrochromic device exhibits transparency or blackness after being switched on; the second electrochromic device exhibits transparency or whiteness after being switched on.

4. The display as claimed in claim 3, wherein when the backlight module turns on, the controller controls the second electrochromic device corresponding to the white pixels of the image to switch on and become transparent, the first electrochromic device corresponding to the white pixels of the image to switch on and become transparent, enabling the emitted light of the backlight module to pass through both first and second electrochromic device, making the background of the display appear white; the controller controls the second electrochromic device corresponding to the black pixels of the image to switch on and become transparent, the first electrochromic device corresponding to the black pixels of the image to switch on and turn black, enabling the emitted light of the backlight module to pass through the second electrochromic device corresponding to black pixels of the image, then absorbed by the first electrochromic devices, making the display display black.

5. The display as claimed in claim 3, wherein when the backlight module turns off, the controller controls the second electrochromic device corresponding to the white pixels of the image to switch on and become white, the first electrochromic device corresponding to the white pixels of the image to switch on and become transparent, an external lighting is reflected by the second electrochromic device corresponding to the white pixels of the image, making the display display white;

the controller controls the second electrochromic device corresponding to the black pixels of the image to switch on and turn transparent, the first electrochromic device corresponding to the black pixels of the image to switch on and turn black, the external lighting to pass through the second electrochromic device corresponding to the black pixels of the image, absorbed by the corresponding first electrochromic device, making the display display black.

6. The display as claimed in claim 1, wherein when the switch in the first state, the backlight module is on; when the switch in the second state, the backlight module is off.

7. The display as claimed in claim 1, wherein the first electrochromic device comprises a sequentially stacking, in the following order, a first transparent base layer, a first transparent conductive layer, an electrochromic layer, an electrolyte layer, an ion storage layer, a second transparent conductive layer, and a second transparent base layer.

8. The display as claimed in claim 7, wherein the first transparent base layer and the second transparent base layer are made of glass.

9. The display as claimed in claim 7, wherein the first transparent conductive layer and the second conductive layer are made of indium tin oxide (ITO).

10. The display as claimed in claim 7, wherein the electrochromic layer is made of electrochromic materials.

11. The display as claimed in claim 7, wherein the electrolyte layer is made of conductive materials.

12. The display as claimed in claim 7, wherein the ion storage layer is made of electrochromic materials, wherein an electrochromic property of the electrochromic materials is in contrast to the electrochromic layer.

13. The display as claimed in claim 7, wherein anodic oxidation electrochromic materials are used in the electrochromic layer, the ion storage layer uses cathodic reduction electrochromic materials.

14. The display as claimed in claim 7, wherein the material of the electrochromic layer of the second electrochromic device is different to the first electrochromic device.

* * * * *